US005716199A

United States Patent [19]

Shan-Chieh

[11] Patent Number: 5,716,199

[45] Date of Patent: Feb. 10, 1998

[54] AIR PUMP WITH ADIABATIC WARMING MEANS

[76] Inventor: Wu Shan-Chieh, P.O. Box 55-846, Taipei, Taiwan

[21] Appl. No.: 796,209

[22] Filed: Feb. 7, 1997

[51] Int. Cl.[6] ..... F04B 39/00

[52] U.S. Cl. ..... 417/312; 417/313; 417/423.9

[58] Field of Search ..... 417/312, 313, 417/423.9, 572

[56] References Cited

U.S. PATENT DOCUMENTS

| | | | |
|---|---|---|---|
| 665,243 | 1/1901 | Luria | 5/422 |
| 4,264,282 | 4/1981 | Crago | 417/312 |
| 4,265,600 | 5/1981 | Mandroian | 417/379 |

*Primary Examiner*—Timothy Thorpe
*Assistant Examiner*—Cheryl J. Tyler

[57] ABSTRACT

An air pump includes: a pump mounted within a housing, a silencer attached to the pump for reducing vibrational shock of the operating pump and for reducing noise by directing the discharged compressed air into the silencer, a heater secured in a heat-exchange chamber in the silencer for heating the discharged air for warming the outlet air with the heater mounted in the silencer well sealed for preventing heat loss, and a suction hood detachably mounted on a side panel of the housing having filter provided in the suction hood for removing dirts laden in the suction air stream, whereby upon dismantling of the suction hood, the hose connected to the sacs of an air mattress may be instantly connected to an inlet adapter of a suction tube connected to the pump for immediately sucking and exhausting air in the sacs for descending the air mattress for an emergency CPR (cardiopulmonary resuscitation).

7 Claims, 5 Drawing Sheets

AIR PUMP WITH ADIABATIC WARMING MEANS

BACKGROUND OF THE INVENTION

A conventional air mattress placed on a hospital bed may serve to cushion a patient once the sacs of the air mattress are inflated by an air pump. For maintaining good ventilation between the patient's body and the air mattress, a plurality of perforations are drilled in each sac to allow the upward discharge of air through the perforations to comfort the patient's body in order to prevent pressure sores or decubitus ulcers to the patient.

However, the conventional air pump for inflating the air mattress has the following drawbacks:

1. No heating or warming device is provided in the portable air pump. In winter or cold weather, the air discharged from the perforated sacs will cool the patient's body to cause uncomfortableness to the patient.

2. Even though a heating device may be added in the portable air pump, for warming air as delivered by the air pump, it however may increase the volume of the portable pump set thereby causing inconvenience for carrying the pump set.

3. For emergency CPR (cardiopulmonary resuscitation) use, the air in the sacs should be exhausted immediately by opening the deflating valves formed on the sacs to empty the mattress for resuscitating the patient stably laid on the exhausted mattress. The air as naturally released from the sac will take a longer time to possibly delay the emergency resuscitation activity.

The present inventor has found the drawbacks of the conventional air pump for air mattresses and invented the present air pump having adiabatic warming device built in the pump housing.

SUMMARY OF THE INVENTION

The object of the present invention is to provide an air pump including: a pump mounted within a housing, a silencer attached to the pump for reducing vibrational shock of the operating pump and for reducing noise by directing the discharged compressed air into the silencer, a heater secured in a heat-exchange chamber in the silencer for heating the discharged air and a suction hood detachably mounted on a side panel of the housing having a filter provided in the suction hood for removing dirts laden in the suction air stream, whereby upon dismantling of the suction hood, the hose connected to the sacs of an air mattress may be instantly connected to an inlet adapter of a suction tube connected to the pump for immediately sucking and exhausting air in the sacs for descending the air mattress for an emergency CPR (cardiopulmonary resuscitation).

DETAILED DESCRIPTION

Figure 1:
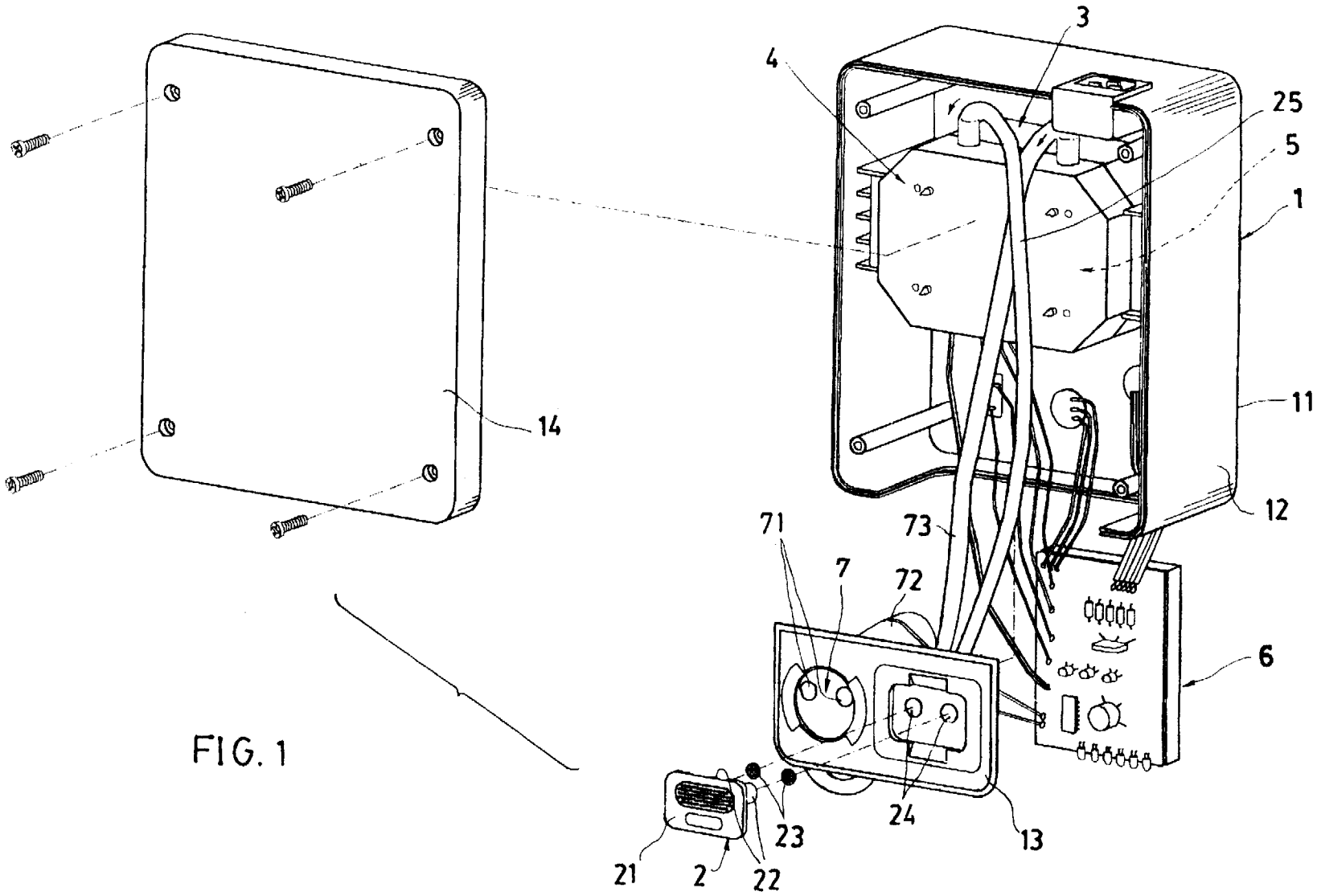
FIG. 1 is a perspective exploded view of the present invention.
Figure 2:
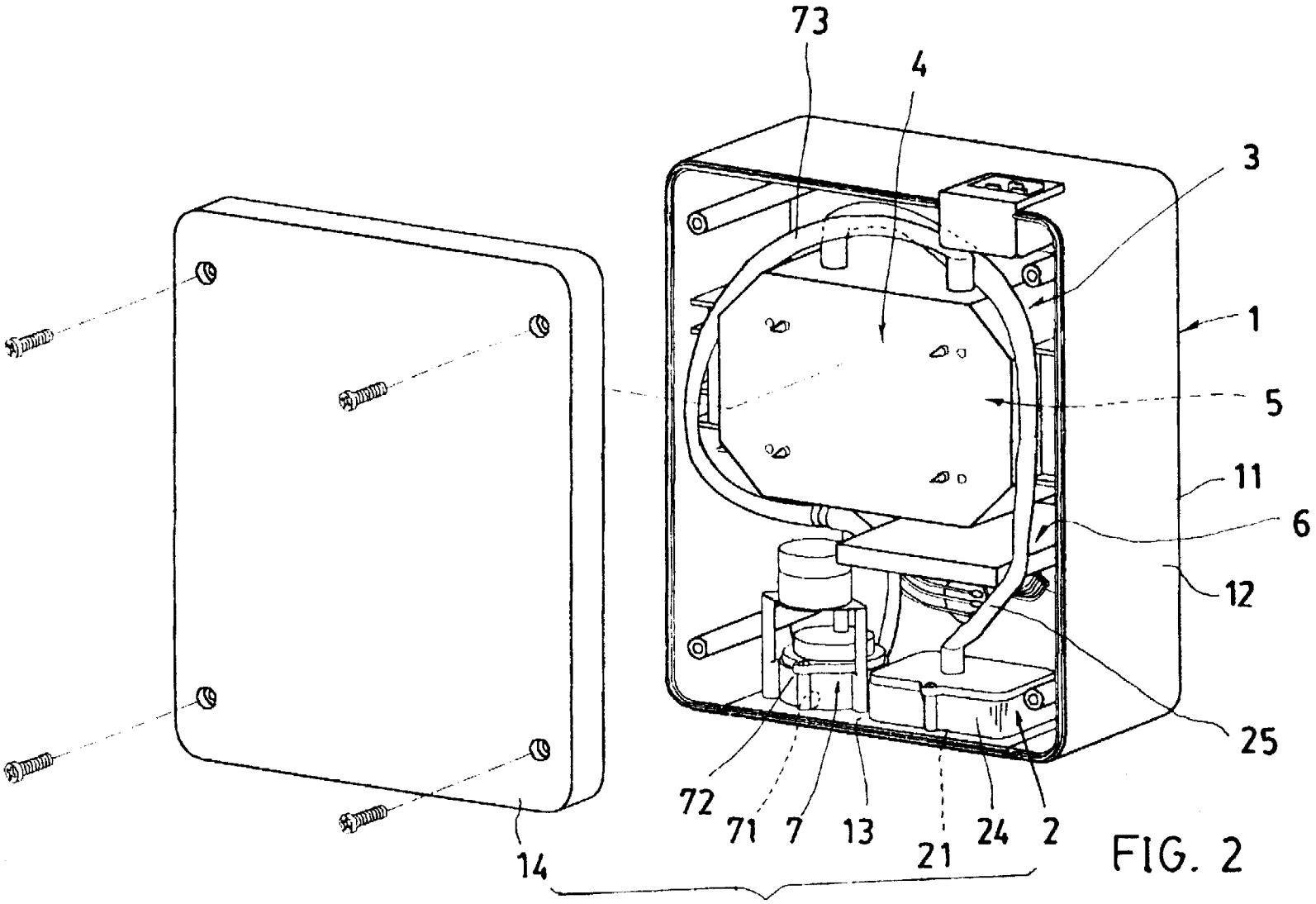
FIG. 2 is a perspective view of the present invention by merely removing the bottom cover.
Figure 3:
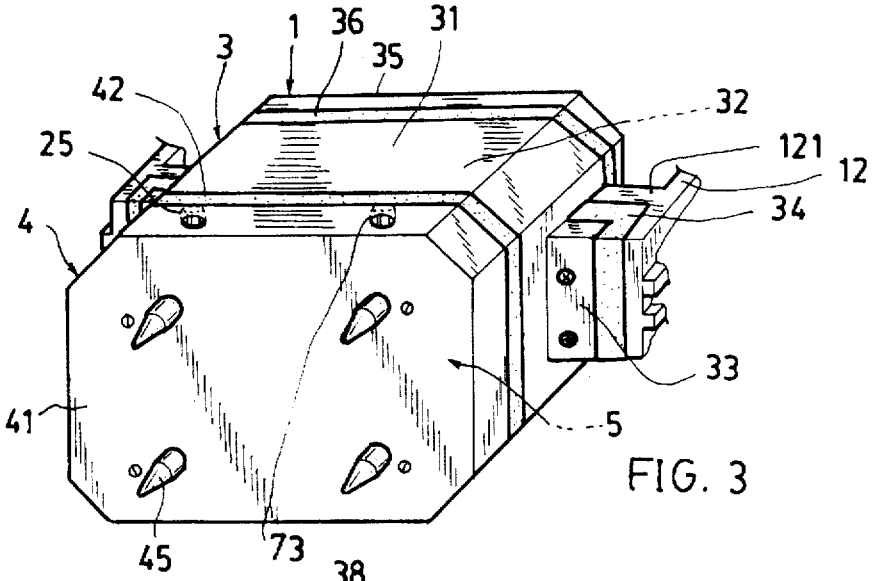
FIG. 3 is a perspective view of the pumping means of the present invention.

As shown in FIGS. 1–4 and 6–9, a preferred embodiment of an air pump of the present invention comprises: a housing 1, a suction tube means 2, a pumping means 3, a silencer 4, a heater 5, an electric control means 6, and a delivery tube means 7.

The housing 1 includes: a top cover 11, at least a side wall 12 protruding downwardly from the top cover 11 having a side panel 13 embedded or fixed in a side of the side wall 12 for mounting the tube means 2, 7 on the panel 13, and a bottom cover 14 secured on a bottom of the side wall 12.

The suction tube means 2 includes: a suction hood 21 having at least a connecting tube 22 detachably connectable in an inlet adapter 24 formed on the side panel 13 of the housing 1, a filter 23 inserted in each connecting tube 22 for filtering dusts or dirts laden in the air enterring the suction hood 21, and an inlet hose 25 connected between the inlet adapter 24 and the pumping means 3.

The pumping means 3 includes: a casing 31 for mounting at least a pump 32 in the casing 31 with the pump 32 selected from a diaphgram pump, a centrifugal pump and other electrically driven pumps; a plurality of lugs 33 protruding from the casing 31 to be secured on a plurality of brackets 121 formed on an inside wall of the housing 1 by sandwiching a side cushioning pad 34 in between each lug 33 of the pump casing 31 and each bracket 121 of the housing 1; a top lid 35 contiguous to the top cover 11 for covering a top opening of the casing 31 having an upper cushioning pad 36 packed between the top lid 35 and an upper edge portion of the casing 31; a suction port 37 communicated with the silencer 4 and the suction tube means 2 for sucking air into the pump 32; and a discharge duct 38 communicated with the silencer 4 and the delivery tube means 7 for discharging compressed air as boosted by the pump 32. All cushioning pads 34, 36 are made of elastomeric materials such as rubber for shock absorbing and silencing purpose when operating the pump.

The silencer 4 includes: a silencer casing 41 made of thermally and electrically insulative materials having an elastic packing pad 42 made of elastomeric materials such as rubber covering a top opening of the silencer casing 41 and for partitioning the silencer casing 41 from a bottom of the casing 31 of the pumping means 3, a suction chamber 43 formed in a first portion of the silencer casing 41 for connecting the suction tube means 2 and communicating the suction port 37 of the pumping means 3, a heat-exchange chamber 44 formed in a second portion of the silencer casing 41 adjacent to the suction chamber 43 for connecting the delivery tube means 7 and communicating the discharge duct 38 of the pumping means 3, and a plurality of tapered cushioning members 45 protruding from a bottom of the silencer casing 41 and tapered towards a bottom cover of the housing 1. The elastic packing pad 42 and the tapered cushioning members 45 are provided for absorbing vibrational shock when operating the pump 32 for silencing purpose. The heat-exchange chamber 44 of the silencing chamber will slow down the velocity of the air delivered by the pumping means 3 for silencing purpose. Meanwhile, the heater 5 mounted in the heat-exchange chamber 44 may also serve as a damper or baffle for slowing down the velocity of compressed air delivered from the pump 32 and discharged from the heat-exchange chamber 44 to further reduce the noise caused by the air delivered when operating the pump 32.

Figure 10:
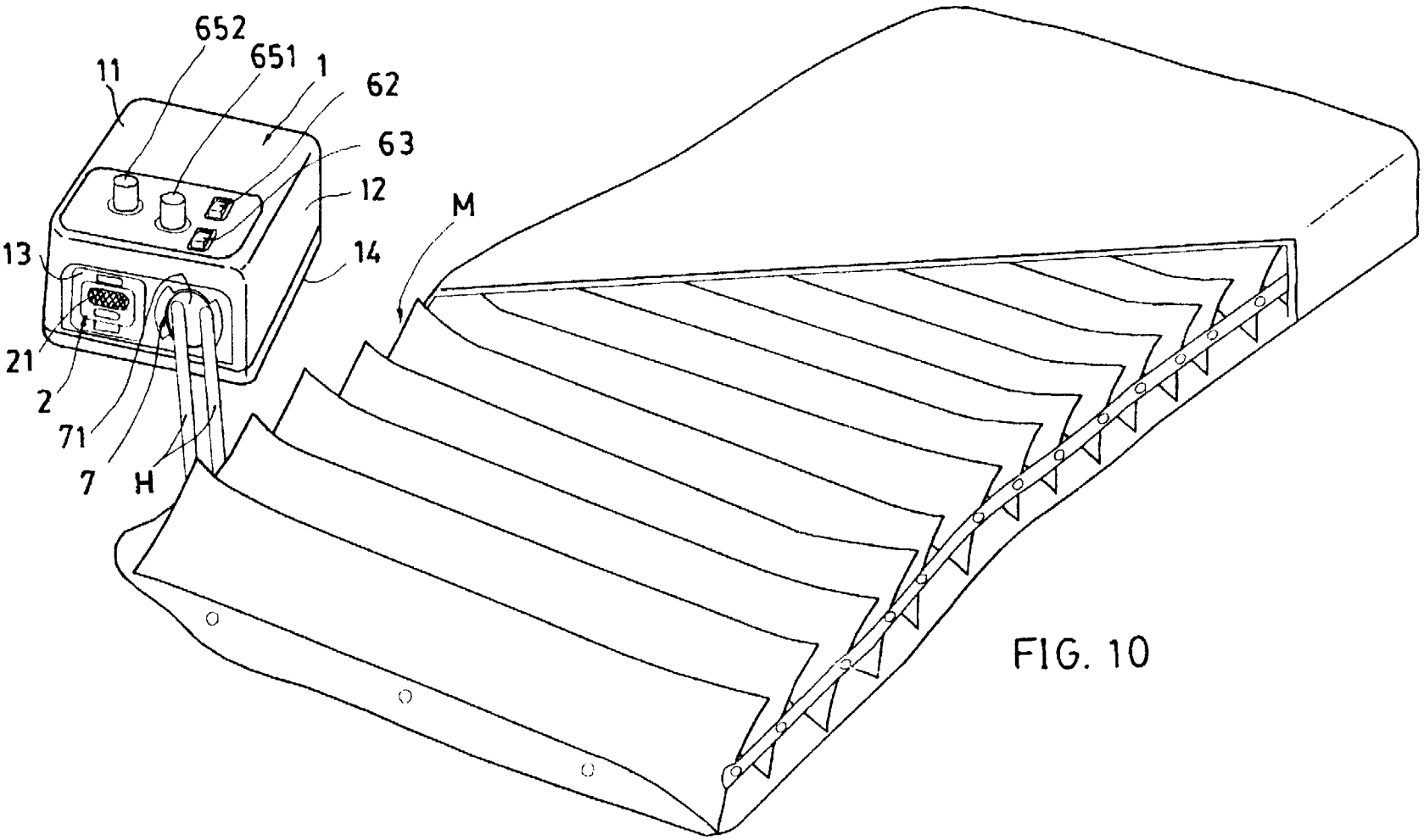
FIG. 10 is an illustration when using the present invention for inflating an air mattress.

The heater 5 provided in the heat-exchange chamber 44 of the silencing chamber will heat and warm the compressed air as boosted by the pump 32 and the air will be pumped through the delivery tube means 7 to an inflatable air mattress M used in a hospital bed by plural hoses H. The two hoses H as shown in FIG. 10 may be alternatively inflated or deflated for supplying air to two sets of sacs of the air mattress for rippling the mattress for comfortably ventilating the patient's body rested on the mattress.

Figure 4:
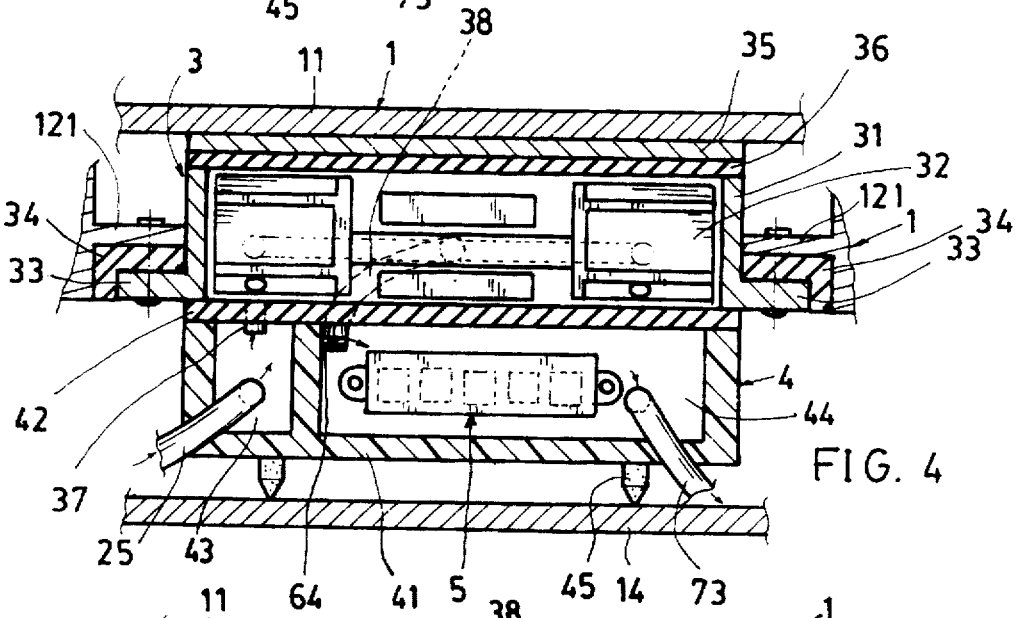
FIG. 4 is a sectional drawing of the pumping means of the present invention.
Figure 5:
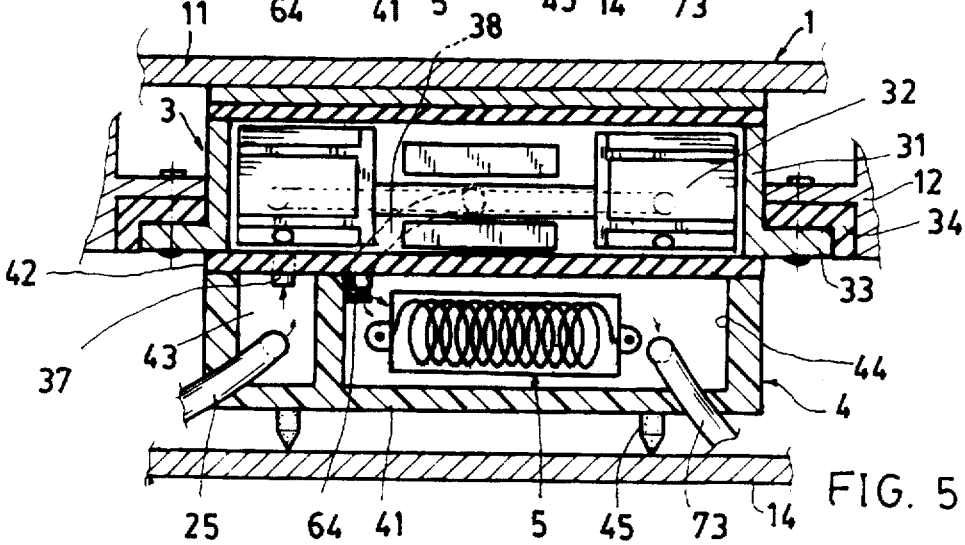
FIG. 5 is a sectional drawing of another preferred pumping means of the present invention.
Figure 7:
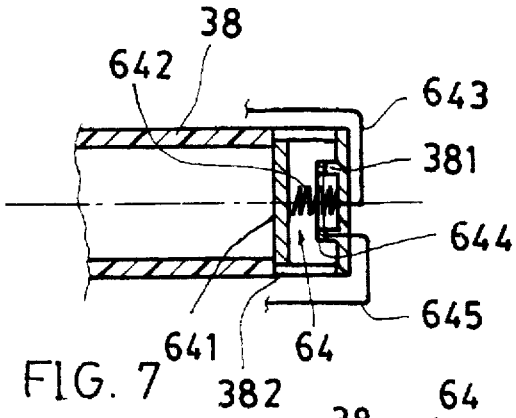
FIG. 7 is a partial sectional drawing of the safety switch for the heater of the present invention when normally opened.
Figure 9:
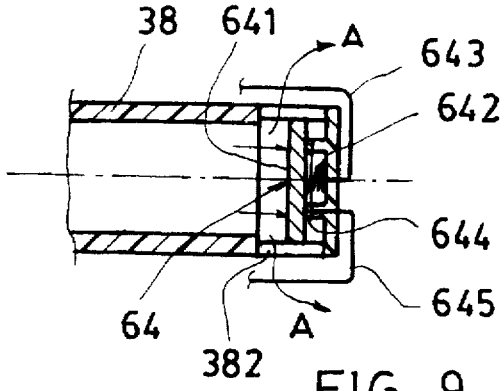
FIG. 9 shows the safety switch when closed in accordance with the present invention.
Figure 8:
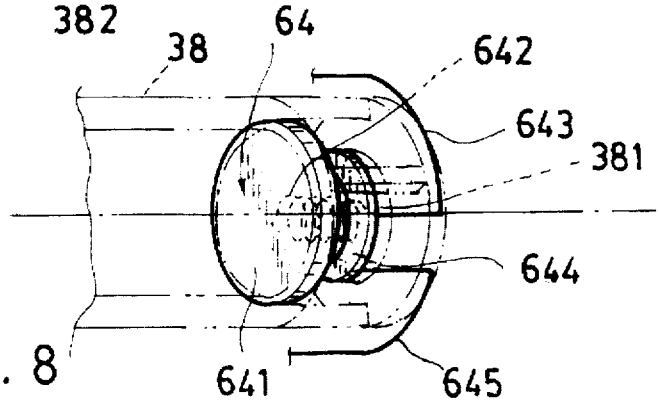
FIG. 8 is a perspective view of the safety switch of FIG. 7.
Figure 6:
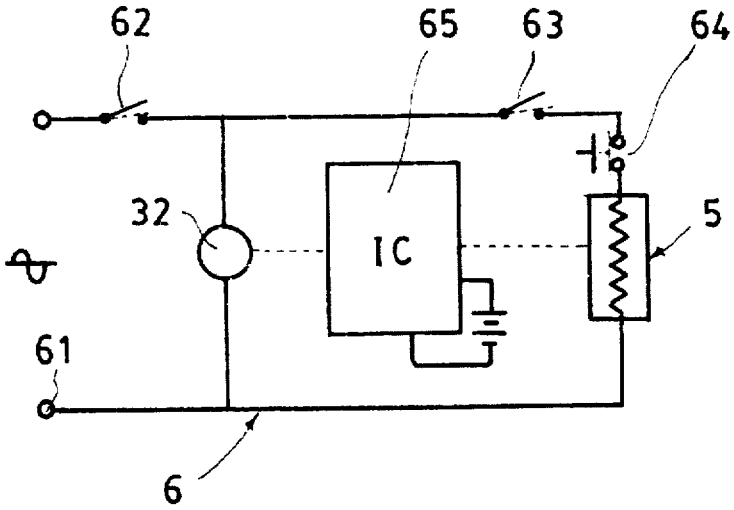
FIG. 6 is a diagram of the electric control means of the present invention.

The heater 5 may be made of a positive-temperature-coefficient (PTC) semiconductor as shown in FIG. 4, or may be made of a heating coil as shown in FIG. 5, not limited in the present invention.

The heater 5 secured in the heat-exchange chamber 44 in the silencer 4 will be thermally insulative to prevent heat loss of the heater to increase the heating efficiency for energy-saving purpose. Also, within the well sealed chamber 44 of the silencer 4, the heating elements such as the PTC semiconductors or the heating coil will not be attacked by moisture and can prevent from corrosion or erosion by the environmental pollutants, especially when the pump of the present invention is provided to inflate the buoyancy float as used in a swimming pool or in a life jacket or to supply air to an aquarium (not shown).

The electric control means 6 as shown in FIGS. 6–9 includes: a power source 61, a main switch 62 for switching on or off the power source 61 supplied to the pump (motor or electric driving system) 32, a heater switch 63 for switching on or off the heater 5, a safety switch 64 connected in series between the heater switch 63 and the heater 5 between two poles of the power source, and an integrated circuit (IC) 65 for controlling the operation of the pump 32 and the heater 5. Even after switching off the heater 5, there may be a time delay for still operating the pump for delivering cooling air for cooling the heater 5 when not in use.

The safety switch 64 includes: an electrically conductive disc 641 normally facing an end portion of the discharge duct 38 and secured with an electrically conductive restoring spring 642 secured on a retainer 381 linked to an end portion of the discharge duct 38 of the pumping means 3 with the disc 641 and the restoring spring 642 connected to a first pole of the power source 61, and a contactor 644 annularly formed on the retainer 381 to be electrically connected with a second pole 645 of the power source 61 with the discharge duct 38 having at least an opening 382 formed in the end portion of the duct for discharging compressed air into the heat-exchange chamber 44 to be heated by the heater 5, whereby upon delivery of compressed air from the pump 32 through the discharge duct 38, the disc 641 will be forcibly pushed to contact the contactor 644 for closing the two poles 643, 645 of the power source for powering the heater 5.

The electric control means 6 further includes a timer knob 651 for adjusting the timing for operating the pump 32 for delivering compressed air outwardly, and a pressure adjusting knob 652 for adjusting the output pressure of the compressed air as delivered from the pump 32. The pumping operation and control system of this invention can be modified by those skilled in the art, not limited in this invention.

The delivery tube means 7 includes: an outlet adapter 71 formed on the side panel 13 for connecting plural hoses H for delivering air outwardly as shown in FIG. 10, a control valve 72 connected with the outlet adapter 71, and an outlet hose 73 connected between the control valve 72 and the heat-exchange chamber 44 of the silencer 4 for delivering compressed air from the pump 32 to the outlet adapter 71. The control valve 72 may be electrically connected with the integrated circuit 65 of the electric control means 6 for controlling the timing for operating the pump or for controlling the alternative pumping sequence for alternatively inflating two sets of sacs of an air mattress M through two hoses by an alternative switching mechanism (not shown) provided in the control valve 72 or in other suitable location in the housing 1 by those skilled in the art.

For emergency CPR use, the suction hood 21 may be suddenly dismantled from the inlet adapter 24 of the suction tube means 2, and the hoses H to the air mattress M may be connected with the inlet adapter 24 (FIG. 1), whereby upon actuation of the pump 32, the air in the mattress M may be quickly sucked by the pump of this invention to exhaust and empty the mattress for cardiopulomary resuscitation (CPR).

The present invention is superior to the conventional air pump for inflatable air mattress with the following advantages:

1. The heater 5 is mounted in the heat-exchange chamber 44 of the silencer 4 under a well sealing circumstance for preventing heat loss for warming the air delivered from the pump 32.

2. The heater 5 provided in the silencer 4 will serve as a baffle for reducing the velocity of the compressed air stream from the pump 32, thereby reducing the noise of the pumping means 3.

3. The heater 5 provided in the silencer 4 will prevent from moisture attack, pollutant contamination, corrosion or erosion by the environmental factors.

4. The suction tube means 2 is provided with filters 23 for filtering dusts or dirts laden in the air for enhancing a hygienic environment for health purpose.

5. The suction hood 21 of the suction tube means 2 is detachable for connecting the hoses to the air mattress for instantly sucking and emptying the mattress for emergency CPR use.

6. Safety switch 64 is actuated only after the pump 32 is operated since the air delivered from the pump 32 will close the safety switch 64 for closing the circuit of the heater 5. Otherwise, if the pump is out of order and inoperative, even the heater switch 63 is switched on, no air is produced from the system and the switch 64 is normally opened, without closing the circuit of the heater 5, thereby preventing an unwanted heating of the heater 5 for enhancing safety.

The present invention may be modified without departing from the spirit and scope of the present invention. Other kinds of safety switch 64 may be modified and designed by those skilled in the art.

I claim:

1. An air pump comprising:

a housing having a suction tube means and a delivery tube means mounted on a side panel of the housing for sucking inlet air inwardly into the housing and for discharging compressed air outwardly from the housing;

a pumping means attached with a silencer resiliently mounted in said housing, said silencer operatively reducing noise as produced from said pumping means when operated;

said suction tube means and said delivery tube means respectively connected with said pumping means through said silencer; and a heater mounted in said silencer for dampening the compressed air discharged from the pumping means for reducing the noise caused by the pumping means and for heating the compressed air from said pumping means for warming the air delivered outwardly through said delivery tube means.

2. An air pump according to claim 1, wherein said suction tube means includes: a suction hood having at least a connecting tube detachably connectable in an inlet adapter formed on the side panel of the housing, a filter inserted in each said connecting tube for filtering dusts laden in the air enterring the suction hood, and an inlet hose connected between the inlet adapter and the pumping means.

3. An air pump according to claim 1, wherein said pumping means includes: a casing 31 for mounting at least a pump in the casing; a plurality of lugs protruding from the casing to be secured on a plurality of brackets formed on an inside wall of the housing by sandwiching a side cushioning pad in between each said lug of the casing and each bracket of the housing; a top lid contiguous to a top cover of the housing for covering a top opening of the casing having an upper cushioning pad packed between the top lid and an upper edge portion of the casing; a suction port communicated with the silencer and the suction tube means for sucking air into the pump; and a discharge duct communicated with the silencer and the delivery tube means for discharging compressed air as discharged by the pump.

4. An air pump according to claim 3, wherein said silencer includes: a silencer casing made of thermally and electrically insulative materials having an elastic packing pad made of elastomeric materials covering a top opening of the silencer casing and for partitioning the silencer casing from a bottom of the casing of the pumping means, a suction chamber formed in a first portion of the silencer casing for connecting the suction tube means and communicating the suction port of the pumping means, a heat-exchange chamber formed in a second portion of the silencer casing adjacent to the suction chamber for connecting the delivery tube means and communicating the discharge duct of the pumping means with a heater mounted in the heat-exchange chamber for heating air flowing from the discharge duct to the delivery tube means, and a plurality of tapered cushioning members protruding from a bottom of the silencer casing and tapered towards a bottom cover of the housing; said heater controlled by an electric control means.

5. An air pump according to claim 4, wherein said electric control means includes: a power source, a main switch for switching on or off the power source supplied to the pumping means, a heater switch for switching on or off the heater, a safety switch connected in series between the heater switch and the heater between two poles of the power source, and an integrated circuit for controlling the operation of the pumping means and the heater.

6. An air pump according to claim 5, wherein said safety switch includes: an electrically conductive disc normally facing an end portion of the discharge duct from said pumping means and secured with an electrically conductive restoring spring secured on a retainer linked to an end portion of the discharge duct of the pumping means with the disc and the restoring spring connected to a first pole of the power source, and a contactor annularly formed on the retainer to be electrically connected with a second pole of the power source with the discharge duct having opening formed in the end portion of the duct for discharging compressed air into a heat-exchange chamber to be heated by the heater, whereby upon delivery of compressed air from the pumping means through the discharge duct, the disc will be forcibly pushed to contact the contactor for closing the first and second poles of the power source for powering the heater.

7. An air pump comprising:

a housing having a suction tube means and a delivery tube means mounted on a side panel of the housing for sucking inlet air inwardly into the housing and for discharging compressed air outwardly from the housing;

a pumping means attached with a silencer resiliently mounted in said housing, said silencer operatively reducing noise as produced from said pumping means when operated;

said suction tube means and said delivery tube means respectively connected with said pumping means through said silencer; and a heater mounted in said housing for heating the compressed air from said pumping means for warming the air delivered outwardly through said delivery tube means.

* * * * *